US005476306A

United States Patent [19]

Golynsky

[11] Patent Number: 5,476,306

[45] Date of Patent: Dec. 19, 1995

[54] CHAIR BACK SUPPORT ADJUSTMENT MECHANISM

[75] Inventor: Arkady Golynsky, Allentown, Pa.

[73] Assignee: Westinghouse Electric Corporation, Pittsburgh, Pa.

[21] Appl. No.: 182,812

[22] Filed: Jan. 13, 1994

[51] Int. Cl.[6] ..... A47C 1/025

[52] U.S. Cl. ..... 297/362.12; 297/362; 297/463.1

[58] Field of Search ..... 297/366–369, 297/362.12, 362, 354.12, 361.1, 353, 354.1, 300, 301, 306, 363–365, 370–372, 463.1

[56] References Cited

U.S. PATENT DOCUMENTS

| | | | |
|---|---|---|---|
| Re. 32,884 | 3/1989 | Kluting et al. | 297/367 |
| 3,719,387 | 3/1973 | Boschen et al. | 297/355 |
| 3,931,996 | 1/1976 | Yoshimura | 297/366 |
| 4,294,488 | 10/1981 | Pickles | 297/367 |
| 4,541,672 | 9/1985 | Fukuta | 297/367 |
| 4,709,963 | 12/1987 | Uecker | 297/316 |
| 4,709,965 | 12/1987 | Kazaoka et al. | 297/366 |
| 4,765,680 | 8/1988 | Kawashima | 297/367 |
| 4,836,608 | 6/1989 | Sugiyama | 297/367 |
| 4,854,641 | 8/1989 | Reineman et al. | 297/306 X |
| 4,875,735 | 10/1989 | Moyer et al. | 297/367 |
| 5,028,061 | 7/1991 | Hawkes | 280/47.4 |
| 5,029,940 | 7/1991 | Golynshy et al. | 297/301 |

FOREIGN PATENT DOCUMENTS

| | | | |
|---|---|---|---|
| 474198 | 9/1952 | Italy | 297/369 |
| 663526 | 12/1987 | Switzerland | 297/306 |
| WO8706810 | 11/1987 | WIPO | 297/300 |

*Primary Examiner*—Milton Nelson, Jr.

[57] ABSTRACT

A mechanism for adjusting the angular position of the seat back relative to the chair seat on an office chair. A chair back support member attached to the seat back has a curved lower end. A chair seat support member attached to the chair seat has a curved rear end adapted to receive the curved lower end of the chair back support member. A first curved gear segment member having a plurality of closely spaced teeth is secured to the rear of the curved lower end of the chair back support member. A second curved gear segment member having a plurality of closely spaced teeth is retained within a spring loaded housing attached to the curved rear end of the chair seat support member. A lever which contacts the second curved gear segment member moves the teeth of the second curved segment member in or out of engagement with the teeth of the first curved segment member allowing the user to angularly adjust the chair back relative to the chair seat and to lock it into the selected angular position.

11 Claims, 5 Drawing Sheets

CHAIR BACK SUPPORT ADJUSTMENT MECHANISM

BACKGROUND OF THE INVENTION

This invention relates to chairs. It relates particularly to office type chairs having a padded and upholstered chair seat and a separate, but connected, padded and upholstered chair back, and a mechanism that allows the user to angularly adjust the chair back relative to the chair seat.

Many prior office chairs were designed for aesthetic appearance rather than user comfort. In today's office environment that uses computers, word processors and other similar equipment, great emphasis is needed in the design of office furniture for the comfort of the user. Office chairs need to take into account a number of comfort features, such as the general lumbar curve of the user, release of pressure points around the body of the user, the ability of the chair to accommodate movements of the user and the ease of the user to adjust the chair to maximize comfort.

One important feature of an office chair that greatly assists in providing comfort to the user is the ability to adjust the angular position of the chair back support relative to the chair seat.

U.S. Pat. No. 5,029,940 to Golynsky et al., assigned to Westinghouse Electric Corporation, as well as the assignee of the present invention, and the prior patents discussed therein describe prior art examples of office chairs that permit backward tilting of a chair seat and a chair back, either together, separately or together, but at differing rates. However, many of these prior office chair designs required many separate parts, were expensive to construct and often just allowed for the tilting of the chair seat and chair back together without the ability of the user to quickly and easily adjust the angular relationship of the seat back relative to the chair seat.

SUMMARY OF THE INVENTION

It is therefore an object of this invention to provide a mechanism for an office chair that permits the angular position of the chair back relative to the chair seat to be quickly and easily adjusted by the user for the desired comfort and then locked into the selected position.

It is another object of this invention to provide a mechanism for an office chair that permits angular adjustments of the chair back relative to the chair seat and offers more flexibility and a greater degree of comfort to the user than previous chair designs.

It is a still further object of this invention to provide a chair back angular adjustment and locking mechanism that is easily adapted to a number of chair designs, is attractive in appearance, is reliable and is capable of being manufactured at a reasonable cost.

It has been discovered that the foregoing objects can be attained by a chair having a chair seat and a separate chair back with a mechanism for adjusting and locking the angular position of the chair back relative to the chair seat comprised of a chair back support member attached to the chair back and having a curved lower end and a chair seat support member attached to the underside of the chair seat and having a curved rear end adapted to receive the curved lower end of the chair back support member. A first curved gear segment member is secured to the rear of the curved lower end of the chair back support member. This first curved gear segment member has a plurality of closely spaced teeth on the rear surface thereof. A second curved gear segment member having a plurality of closely spaced teeth on the front surface thereof is retained within a spring loaded housing to provide direct contact with the first curved gear segment member. A pivotal lever contacts an actuator shaft attached to the second curved gear segment member to move the teeth of the second curved gear segment member into or out of engagement with the teeth of the first curved gear segment member whereby the angle of the chair back relative to the chair seat may be angularly adjusted and locked into place by the user.

DESCRIPTION OF THE PREFERRED EMBODIMENT

Figure 1:
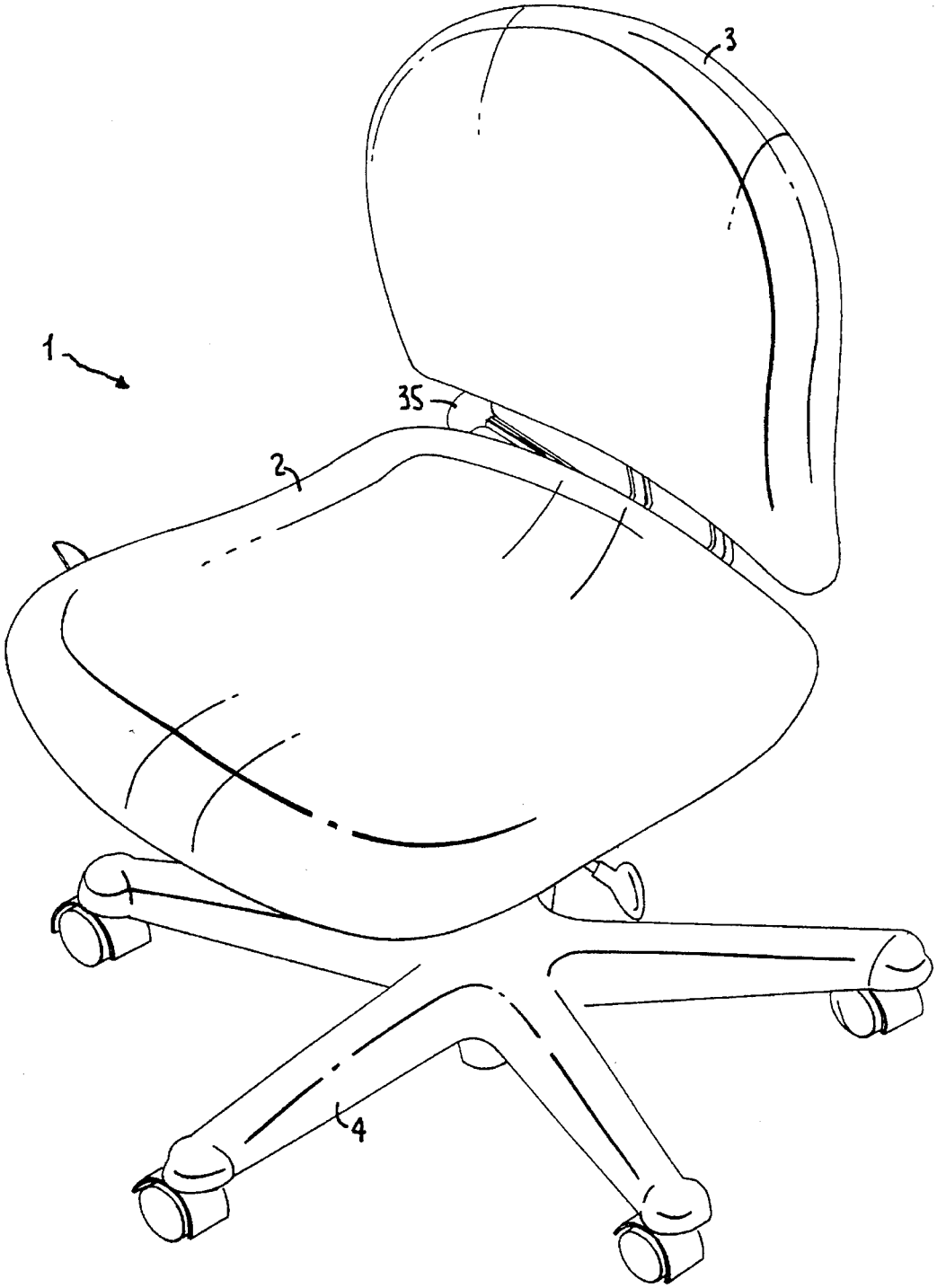
FIG. 1 is an isometric view of an office chair having the chair back adjustment mechanism of this invention.
Figure 2:
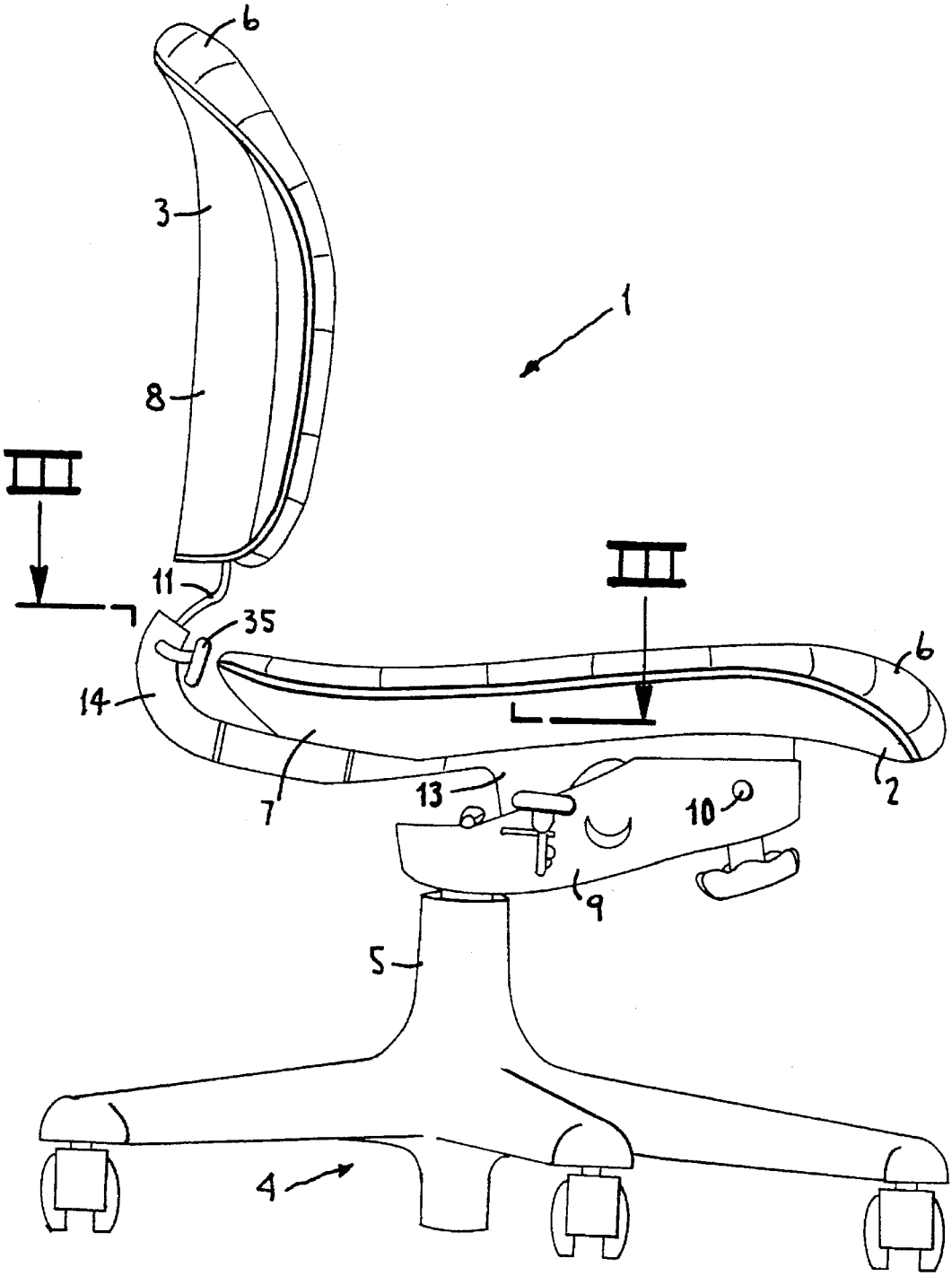
FIG. 2 is a side view of the office chair illustrated in FIG. 1.

FIGS. 1 and 2 are an isometric view and a side view, respectively, of an office chair 1 having the chair back angular adjustment mechanism of this invention. The chair 1 is basically comprised of a chair seat 2 and a separate but connected chair back 3 supported on a chair base 4 by a support column 5 that contains a chair seat 2 height adjusting mechanism (not shown), which may be a pneumatic cylinder. In describing the preferred embodiment of the chair back angular adjustment mechanism of this invention, the terms "front" and "rear" will relate to the "front" of the chair seat 2 which supports the lower thighs and knees of the user. The terms "upper" and "lower" will relate to the top of the chair back 3 which supports the upper back and shoulders of the user.

Both the chair seat 2 and the chair back 3 are comprised of inner liners and inner cushions (not shown) covered with a fabric 6 or other upholstery material and mounted on injection molded plastic outer shells 7 and 8. The chair seat 2 for this embodiment, is attached to a chair seat housing 9 supported on the support column 5. The chair seat housing 9 contains springs, linkage and controls that permit the chair seat 2 to pivot and tilt about pivot point 10 and to be locked into horizontal or tilted positions, as desired.

Figure 3:
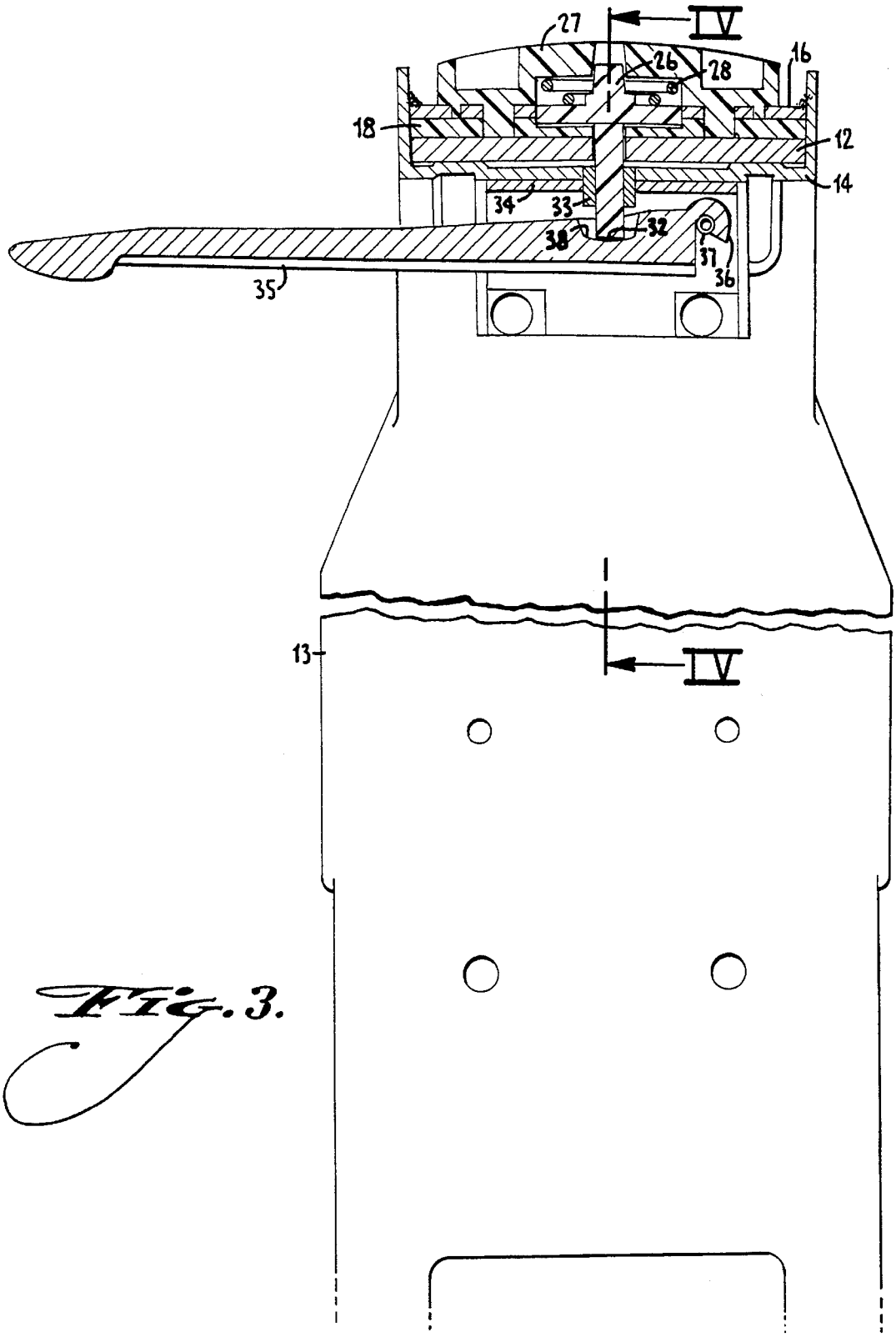
FIG. 3 is top plan view, partly in section, illustrating the preferred embodiment of the chair back adjustment mechanism of this invention.
Figure 4:
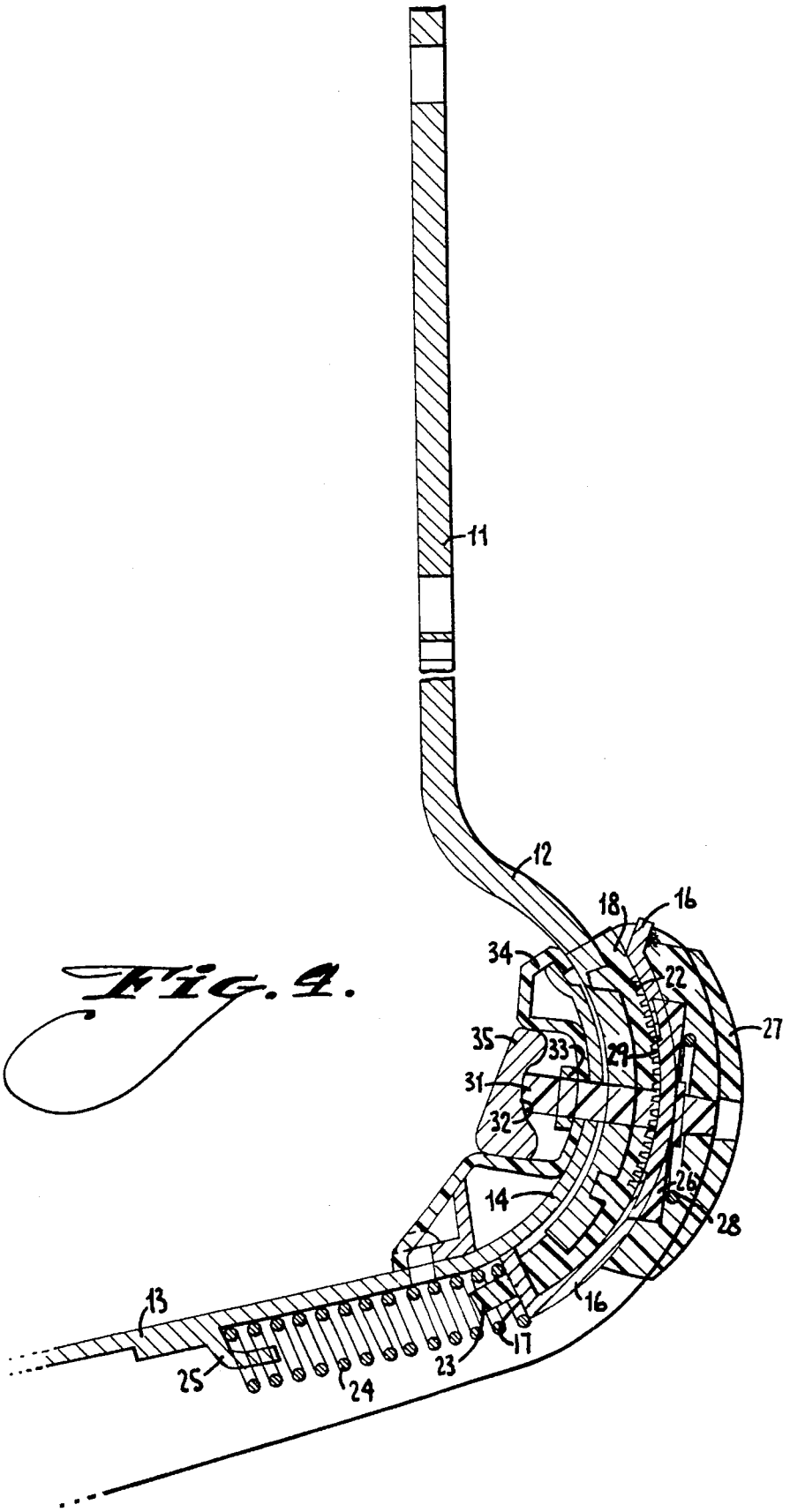
FIG. 4 is a sectional view taken along section lines IV—IV in FIG. 3 illustrating the preferred embodiment of the chair back adjustment mechanism of this invention.

As best shown in FIGS. 3 and 4, the chair 1 of this invention is provided with a steel chair back support member 11 in the general form of a "J-bar" whose upper end is positioned between the inner liner and the plastic outer shell 8 of the chair back 3 and secured thereto by suitable brackets and fasteners (not shown). The lower end 12 of the chair back support member 11 is curved, preferably as a circular curve, which will form half of a pivotal seat to back connection.

The chair 1 of this invention is also provided with a steel chair seat support member 13 whose front end is attached to the underside of the chair seat 2 between the inner liner and outer shell 7 and secured thereto by suitable brackets and fasteners (not shown). The rear end 14 of the chair seat support member 13 is curved, preferably a circular curve, to form the second half of a pivotal seat to back connection. A curved steel bracket 16 is welded or otherwise attached to the back and to the side flanges of the curved rear end 14 of the chair seat support member 13 and has a connecting flange 17. The curved rear end 14 of the chair seat support member and the curved bracket 16 are adapted to receive the curved lower end 12 of the chair back support member 11 between them to provide guide members that will allow a pivotal seat to back connection and to retain the components used to adjust and lock the connection, as best illustrated in FIG. 4. If desired the bottom and rear of the chair back support member 11 may be covered with a plastic or metal shield (not shown) to conceal the mechanism described below.

As shown in FIG. 4, a first curved gear segment member 18 is secured to the rear surface of the lower end 12 of the chair back support member 11 and the front surface of the curved bracket 16. The rear surface of the first curved gear segment member 18 is provided with a plurality of closely spaced teeth 22.

The connecting flange 17 has an opening for a projection 23 on the bottom of member 18 that fits through an opening in the connecting bottom flange 17 and retains the upper end of a cylindrical coil compression spring 24. The lower end of the cylindrical coil compression spring 24 is retained by a steel clip 25 welded to the chair seat support member 13, as illustrated in FIG. 4.

Figure 5:
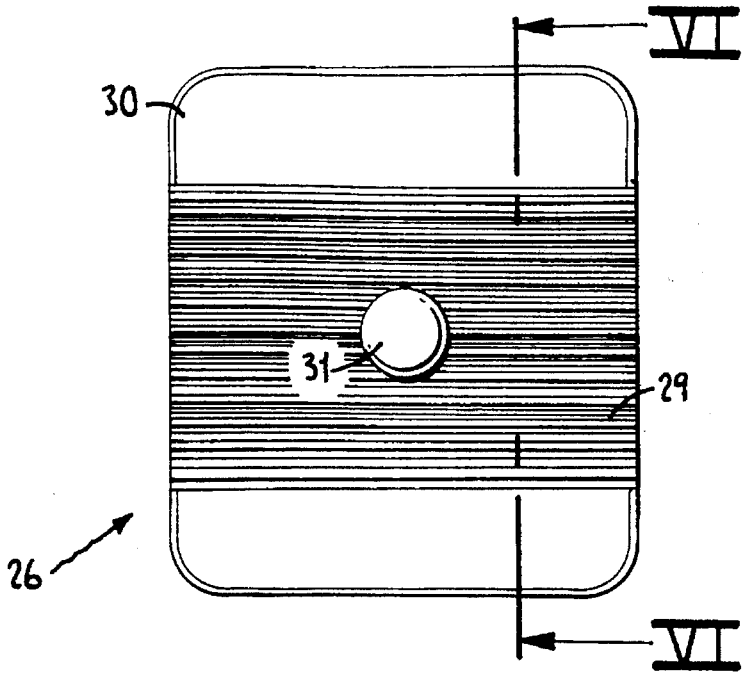
FIG. 5 is a front elevational view of the second curved segment member used in the preferred embodiment of the chair back adjustment mechanism of this invention.
Figure 6:
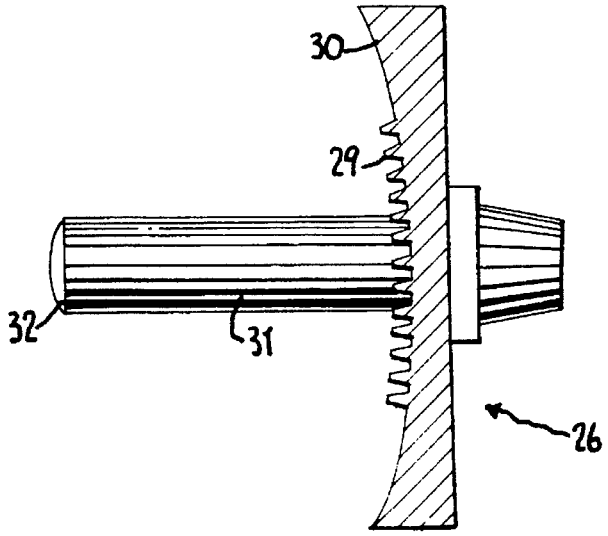
FIG. 6 is a side view of the second curved segment member used in the preferred embodiment of the chair back adjustment mechanism of this invention.

A second curved gear segment member 26, illustrated in FIGS. 5 and 6, is retained within a housing 27 fitted with a conical compression spring 28, attached to the bracket 16 which is welded to the rear and to the side flanges of the chair seat support member 13. The second curved gear segment member 26 has a plurality of closely spaced teeth 29 on the front surface 30 thereof. The second curved segment member 26 is also provided with an actuator shaft 31 that projects from the front surface 30 thereof, as illustrated in FIGS. 5 and 6.

The front end 32 of the actuator shaft 31 of the second curved gear segment member 26 projects through an opening in the curved rear end 14 of the chair seat support member 13 and a large open slot formed in the first curved gear segment member 18 and a bushing 33 formed in an actuating lever retainer 34 that holds and retains an actuating lever 35. The actuating lever retainer 34 is attached to the front of the curved rear end 14 of the chair seat support member 13, as shown in FIG. 4

As best illustrated in FIG. 3, the actuating lever 35 extends substantially horizontally outwardly between the back of the chair seat 2 and the bottom of the chair back 3 to a position easily accessible by the hand of the user. The inner end of the actuating lever 35 has curved hook portion 36 that fits around a pivot pin 37 and a recess 38 that fits around the front end 32 of the actuator shaft 31 of the second curved gear segment member 26.

A forward movement by the user of the outer end of the actuating lever 35 causes the lever to pivot about the pivot pin 37 and move the second curved gear segment member 26 rearwardly compressing the conical compression spring 28 in the housing 27 and also causing the teeth 29 on the second curved gear segment member 26 to disengage from the teeth 22 on the first curved gear segment member 18, which allows the chair back 3 to be angularly rotated and adjusted relative to the chair seat 2 to the desired position by leg and back pressure from the user. When the user releases the lever, the conical compression spring 28 will move the second curved gear segment member 26 forward and the teeth 29 on the second curved gear segment member 26 will again engage the teeth 22 on the first curved gear segment member 18 and lock the chair back 3 in the new angular position relative to the chair seat 2, selected by the user. If no pressure is applied by the legs and back of the user to change the angular position of the chair back 3 while the actuating lever 35 is held in the forward position by the user, the cylindrical compression spring 24 will automatically move the lower end of the chair back support member 11 and the chair back 3 upwardly to a vertical, upright neutral, position.

With some chair designs, it may be desirable to mount the actuating lever 35 behind the chair back outer shell 8 instead of the position shown in FIGS. 3 and 4. This alternative mount would require changing the geometry of the actuating lever 35 and the second curved gear segment member 26 so that the actuating lever 35 would pull rather than push the teeth 29 of the second curved gear segment member 26 out of engagement with the teeth 22 of the first curved gear segment member 18.

The first curved gear segment member 18, the second curved gear segment member 26, the spring retainer housing 27, the lever retention member 34 and the actuating lever 35 are preferably made of a reinforced structural plastic, such as a glass reinforced nylon, but could be made of metal or other structural materials. The face angle of the teeth 22 and 29 on the first curved segment member 18 and the second curved segment member 26 in this embodiment are preferably set at about 15–30 degrees since such an angle provides sufficient strength to the teeth when engaged with each other in the locked position and provides a smooth engagement and disengagement in service.

While I have described this invention by illustrating and describing the preferred embodiments of it, I have done this by way of example, and am not to be limited thereby as there are modifications and adaptions of these embodiments that could be made within the scope of this invention.

I claim:

1. A chair having a chair seat and a separate chair back, means for adjusting and locking the angular position of the chair back relative to the chair seat comprising:

(a) a chair back support member attached to the chair back and having a curved lower end;

(b) a chair seat support member attached to the underside of the chair seat and having a curved rear end adapted to receive the curved lower end of the chair back support member;

(c) a first curved gear segment member secured to the rear of the curved lower end of the chair back support member, the first curved gear segment member having a plurality of closely spaced teeth on the rear surface thereof;

(d) a second curved gear segment member retained within a spring loaded housing surrounding an opening in the curved rear end of the chair seat support member, the second curved gear segment member having a plurality of closely spaced teeth on the front surface thereof; and (e) means to move the teeth of the second curved gear segment member into or out of engagement with the teeth of the first curved gear segment member whereby the angle of the chair back relative to the chair seat may be adjusted and locked.

2. The chair of claim 1 in which the means to move the teeth of the second curved gear segment member into and out of engagement with the teeth of the first curved gear segment member is a lever pivoted to contact an actuator shaft attached to the second curved gear segment member.

3. The chair of claim 2 in which the lever extends substantially horizontal between the back of the chair seat and the bottom of the chair back.

4. The chair of claim 3 in which a compression spring secured to the chair seat support member engages the curved lower end of the chair back support member.

5. The chair of claim 4 in which the curved lower end of the chair back support member and curved rear end of the chair seat support member are circular curves having a common center.

6. The chair of claim 5 in which the teeth on the first curved gear segment member and the second curved gear segment member have a 15–30 degree face angle.

7. Apparatus for adjusting and locking the angular position of a chair back relative to a chair seat comprising:

(a) a chair back support member for attachment to a chair back and having a curved lower end;

(b) a chair seat support member for attachment to the underside of a chair seat and having a curved rear end adapted to receive the curved lower end of the chair back support member;

(c) a first curved gear segment member secured to the rear of the curved lower end of the chair back support member, the first curved gear segment member having a plurality of closely spaced teeth on the rear surface thereof;

(d) a second curved gear segment member retained within a spring loaded housing surrounding an opening in the curved rear end of the chair seat support member, the second curved gear segment member having a plurality of closely spaced teeth on the front surface thereof; and (e) means to move the teeth of the second curved gear segment member into or out of engagement with the teeth of the first curved gear segment member whereby the angle of the chair back relative to the chair seat may be adjusted and locked.

8. The apparatus of claim 7 in which the means to move the teeth of the second curved gear segment member into and out of engagement with the teeth of the first curved gear segment member is a lever pivoted to contact an actuator shaft attached to the second curved gear segment member.

9. The apparatus of claim 8 in which a compression spring secured to the chair seat support member engages the curved lower end of the chair back support member.

10. The apparatus of claim 9 in which the curved lower end of the chair back support member and the curved rear end of the chair seat support member are circular curves having a common center.

11. The apparatus of claim 10 in which the teeth on the first curved gear segment member and the second curved gear segment member have a 15–30 degree face angle.

* * * * *